US007040732B2

(12) United States Patent
Dudek

(10) Patent No.: US 7,040,732 B2
(45) Date of Patent: May 9, 2006

(54) SYSTEMS AND METHODS FOR MANIPULATING THE AIRFLOW PRODUCED BY FLUID EJECTOR CARRIAGE MOTION

(75) Inventor: Lesley P. Dudek, Webster, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 307 days.

(21) Appl. No.: 10/732,461

(22) Filed: Dec. 11, 2003

(65) Prior Publication Data

US 2005/0128245 A1 Jun. 16, 2005

(51) Int. Cl.
*B41J 29/377* (2006.01)
*B41J 2/01* (2006.01)

(52) U.S. Cl. ..... 347/18; 347/102

(58) Field of Classification Search ..... None
See application file for complete search history.

(56) References Cited

U.S. PATENT DOCUMENTS 6,382,760 B1 5/2002 Peter ..... 347/18
6,631,966 B1 * 10/2003 Watanabe et al. ..... 347/18

* cited by examiner

*Primary Examiner*—Thinh Nguyen
(74) *Attorney, Agent, or Firm*—Oliff & Berridge, PLC

(57) ABSTRACT

A system, method and structure that promotes removing mist, dissipating heat, and/or drying a receiving medium in a fluid ejection device. This is achieved by substantially enclosing the sweep path of the fluid ejector carriage and manipulating the generally enclosed airflow that results from translating the fluid ejector carriage in a sweep direction.

28 Claims, 12 Drawing Sheets

SYSTEMS AND METHODS FOR MANIPULATING THE AIRFLOW PRODUCED BY FLUID EJECTOR CARRIAGE MOTION

BACKGROUND OF THE INVENTION

1. Field of Invention

This invention is directed to systems, methods and structures for manipulating the airflow resulting from fluid ejector carriage motion in fluid ejection devices.

2. Description of Related Art

A variety of systems, methods, structures and/or devices are conventionally used to remove mist which is generated during the operation of fluid ejection devices, such as, for example, ink jet printers. In fluid ejection systems, mist removal is recognized as a significant problem. Very small residual droplets of fluid, such as, for example, ink in ink jet printers, are produced during the fluid ejection process. The residual droplets get caught up in the airflow generated by fluid ejector carriage motion. The residual droplets land indiscriminately, over a period of time, on internal surfaces of the fluid ejection devices. The film left by the residual droplets coats various internal surfaces of the fluid ejection device resulting in, not only cleanliness issues, but also impact to the operation of the fluid ejection device. Specifically, when the film that results from dry residual droplets accumulating on structures along which the carriage is designed to translate, such as, for example, fluid ejector carriage guide rods, the film can impede carriage motion. Additionally, accumulation on various internal sensors degrades the performance of these sensors.

The conventional solution for dealing with mist removal is to add separate, often electrically-driven, fans that can include filters. The disadvantages associated with the addition of separate fans include additional weight and/or structure, greater noise, and increased potential for failure, as well as increased cooling and energy requirements to support the additional fans and like devices.

A variety of systems, methods, structures and/or devices are conventionally used to dissipate heat in thermal fluid ejector modules of fluid ejection devices. The thermal fluid ejector modules of fluid ejection devices, such as, for example, ink jet printers, generate significant amounts of residual heat as the fluid is ejected by heating the fluid to the point of vaporization. This residual heat changes the performance, and ultimately the ejection quality, if the heat remains within the fluid ejector module. During lengthy operation or heavy coverage ejection, the temperature of the thermal fluid ejector module can exceed an allowable temperature limit. Once the temperature limit is exceeded, a slow down or cool down period is normally required to maintain ejection quality.

Many fluid ejection devices, such as, for example, printers, copiers and the like, improve throughput by improving thermal performance. Various techniques are used to remove heat from the fluid ejector module. These techniques include: diverting excess heat into the fluid being ejected; using heat sinks to conduct heat away from the fluid ejector module; and, as with residual mist removal, adding separate fans to increase the total volume of air circulating throughout the fluid ejection device facilitating additional cooling.

Improving heat transfer away from fluid ejection elements can be accomplished by directing flow of ambient air through the fluid ejector carriage and across the heater elements of the fluid ejection module housed in the carriage, and additionally across heat sinks, when installed. U.S. Pat. No. 6,382,760 to Peter, incorporated herein by reference in its entirety, discloses various exemplary embodiments of structures and/or devices for the manipulation of airflow through a fluid ejector carriage for cooling the heater elements and heat sinks.

A variety of systems, methods, structures and/or devices are conventionally used to dry the fluid deposited on a receiving medium by fluid ejection devices and/or to set certain "hot melt" fluids deposited on a receiving medium in a semi-molten state. Print quality in fluid ejection printer devices is enhanced when the fluid ejected onto the receiving medium is rapidly dried and/or set. Again here, separate fans usable to force airflow across the receiving medium have conventionally facilitated this function.

In all cases, the addition of separate fans for mist removal, fluid ejection element cooling, and receiving medium drying results in the disadvantages of additional weight, size, noise, heat production, and/or energy required in the fluid ejection device.

SUMMARY OF THE INVENTION

This invention provides systems, methods and structures for manipulating the airflow resulting from fluid ejector carriage motion.

This invention separately provides systems, methods and structures for containing the sweep path of a fluid ejector carriage as the fluid ejector carriage is driven in a substantially reciprocating fashion along structures upon which the fluid ejector carriage translates, such as, for example, carriage guide rods and/or rails.

This invention is separately directed to systems, methods and structures for improving mist removal, fluid ejector element cooling and fluid drying/setting in fluid ejection devices.

In various exemplary embodiments of the systems, methods and structures according to this invention, the fluid ejector carriage sweep path is enclosed by forming the interior cavity of the fluid ejection device to closely surround a fluid ejector carriage containing at least one fluid ejection module and structures upon which the fluid ejector carriage translates, such as, for example, carriage guide rods and/or rails. For ease of understanding and depiction, guide rods and/or rails will be shown and referred to as exemplary structures upon which a fluid ejector carriage translates. It should be appreciated, however, that the use of the terms guide rods and/or rails throughout is intended to be exemplary only and in no way limiting to the embodiment of any structure upon which a fluid ejector carriage translates.

In various exemplary embodiments of the systems, methods and structures according to this invention, the interior cross-sectional area of a resulting sweep path containment is sized such that it closely fits the silhouette of the sides of the fluid ejector carriage as manufactured or as modified with the addition of separate conforming structures.

In various exemplary embodiments of the systems, methods and structures according to this invention, the sweep path containment is generally closed on all sides, except for the face bounded by the receiving medium, and vented to a specific receiving area adjoining the containment or vented outside the fluid ejection device within which it is contained. The resulting effect is the ability to manipulate the airflow generated by fluid ejector carriage motion in order to accomplish one or more beneficial purposes.

In various exemplary embodiments of the systems, methods and structures according to this invention, containment of the fluid ejector carriage sweep path is accomplished by specifically molding or manufacturing the internal surfaces of existing fluid ejection device components, such as, for example, casings and/or covers, to substantially enclose the fluid ejector carriage sweep path to contain airflow therein. In various exemplary embodiments of the systems, methods, and structures according to this invention, separate structures, such as, for example, shrouds, and/or individual panels may be inserted in the vicinity of the fluid ejection carriage to form a sweep path containment.

In various exemplary embodiments of the systems, methods and structures according to this invention, the cross-sectional area of the sweep path containment should conform as nearly as possible with the cross-sectional profile, or silhouette, of the fluid ejector carriage as manufactured or as augmented.

In various exemplary embodiments of the systems, methods and structures according to this invention, the silhouette of the sides of the fluid ejector carriage can be manipulated, shaped and/or enlarged to fit the internal cross-sectional profile of the fluid ejector sweep path containment by molding or manufacture, or, for example, with the addition of appropriately sized and shaped lightweight baffles to the sides of the fluid ejector carriage.

In various exemplary embodiments of the systems, methods and structures according to this invention, openings, such as, for example, vents and/or channels, are provided at either end of the fluid ejector carriage sweep path containment to channel air from the fluid ejector carriage sweep path containment to outside the fluid ejection device. The fluid ejector carriage, conforming in silhouette to the internal cross-sectional area of the fluid ejector carriage sweep path containment, acts as a piston to draw air in through the opening at one end of the containment while expelling air through the opening at the other end of the containment to facilitate mist removal.

In various exemplary embodiments of the systems, methods and structures according to this invention, simple channels usable to direct the exhausted air out through the top, bottom, back, or front of the fluid ejection device are added. In various exemplary embodiments of the systems, methods and structures according to this invention, filters are added in proximity to the openings.

In various exemplary embodiments of the systems, methods and structures according to this invention, openings, such as, for example, vents and/or channels, are added to the fluid ejector carriage to allow air to flow through the fluid ejector carriage to be drawn past heater elements, and/or installed heat sinks, if any, contained in the fluid ejector carriage to facilitate cooling.

In various exemplary embodiments of the systems, methods and structures according to this invention, at least one additional opening in the face of the fluid ejector carriage that houses or mounts the fluid ejection module may be introduced. Airflow exhausted through such opening facilitates drying and/or setting the fluid deposited on the receiving medium.

It should be appreciated that the functions of mist removal, fluid ejector cooling and fluid drying/setting can be accomplished as individual tasks, or in any combination, based on the manipulation of the airflow accomplished in the various embodiments of systems, methods and structures according to this invention.

These and other features and advantages of the disclosed embodiments are described in, or are apparent from, the following detailed description of various exemplary embodiments of the systems, methods and structures according to this invention.

BRIEF DESCRIPTION OF THE DRAWINGS

Various exemplary embodiments of the invention will be described in detail, with reference to the following figures, wherein.

DETAILED DESCRIPTION OF PREFERRED EMBODIMENTS

The following detailed description of various exemplary embodiments of the fluid ejector carriage sweep path containment and conforming fluid ejector carriage systems according to this invention may refer to and/or illustrate one specific type of fluid ejection system, an ink jet printer, for the sake of clarity and familiarity. However, it should be appreciated that the principles of this invention, as outlined and/or discussed below, can be equally applied to any known, or later-developed, fluid ejection system beyond the ink jet printer specifically discussed herein.

Various exemplary embodiments of the systems, methods and structures according to this invention enable the manipulation of airflow generated by fluid ejector carriage motion in devices, such as, for example, ink jet printers, copiers and/or facsimile machines, to at least one beneficial purpose. These beneficial purposes include: removing residual fluid mist generated in the fluid ejection process; cooling fluid ejector elements heated in the fluid ejection process; drying the fluid deposited on a receiving medium during the fluid ejection process; setting hot melt fluid deposited on a receiving medium during the fluid ejection process; and/or any other purpose wherein it would be advantageous to direct airflow created by the reciprocating motion of a fluid ejector carriage, such as, for example, to supplement or replace separate fans installed to induce airflow for such purpose.

In the various exemplary embodiments of the systems, methods and structures according to this invention, random airflow generated by fluid ejector carriage motion is contained and focused such that increased efficiency is gained with each sweep of the fluid ejector carriage within a fluid ejector carriage sweep path containment to accomplish one or more beneficial purposes. While 100% efficiency in movement and resultant manipulation of the airflow in the sweep path containment is not achievable, particularly in consideration of the requirement for access of the fluid ejection elements to the receiving medium, it is desirable to reduce random leakage from the fluid ejector carriage sweep path containment to the greatest extent. It is further desirable to maintain generally strict tolerances between the silhouette of the fluid ejector carriage and the internal faces of the fluid ejector carriage sweep path containment in order that, with each sweep of the fluid ejector carriage, a maximum percentage of the volume of the air contained within the fluid ejector sweep path containment is manipulated to at least one beneficial purpose. These tolerances, however, should not be designed, manufactured or molded so strictly to risk contact between the fluid ejector carriage and the internal surfaces of the fluid ejector carriage sweep path containment. Such contact would impede fluid ejector carriage motion, produce unintentional frictional drag, and/or generate unwanted noise within the fluid ejection device.

Figure 1:
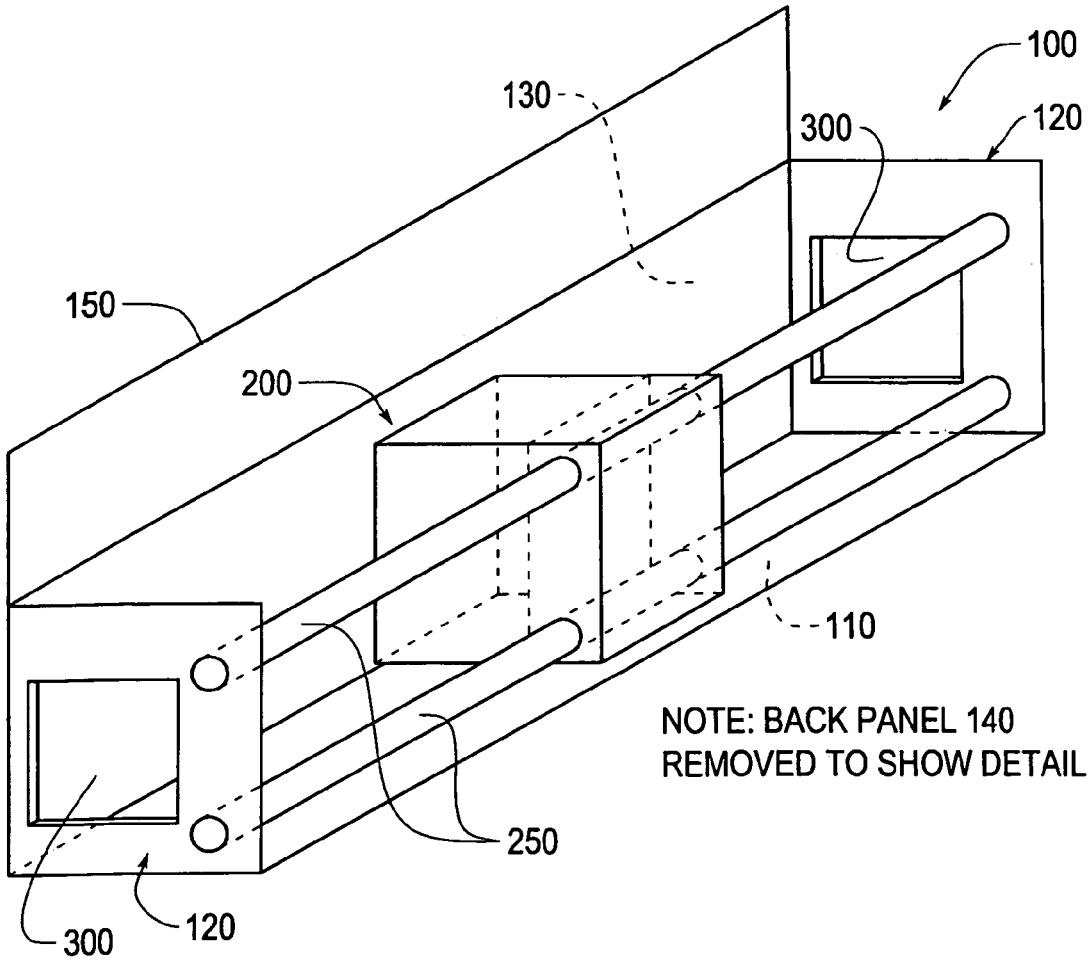
FIG. 1 illustrates a first exemplary embodiment of a fluid ejector carriage sweep path containment, and a fluid ejector carriage, usable with various exemplary embodiments of the systems, methods and structures according to this invention.

FIG. 1 illustrates a first exemplary embodiment of a fluid ejector carriage sweep path containment 100, and a fluid ejector carriage 200, usable with various exemplary embodiments of the systems, methods and structures according to this invention. As shown in FIG. 1, the fluid ejector carriage sweep path containment 100 substantially encloses the fluid ejector carriage 200 and the structures upon which the fluid ejector carriage 200 translates, such as, for example, carriage guide rods and/or rails 250, in a generally reciprocating motion.

In various exemplary embodiments of the systems, methods and structures according to this invention, the fluid ejector carriage sweep path containment 100 is formed from a plurality of individual elements which combine to substantially enclose the fluid ejector carriage 200 and structures upon which the fluid ejector translates. For simplicity, clarity and ease of explanation, the depicted embodiment of the fluid ejector carriage sweep path containment 100 is substantially a box-like containment structure that includes a bottom panel 110, end panels 120, a front panel 130, a back panel 140 (removed in FIG. 1) and a fixed or movable top panel 150. It should be appreciated that the fluid ejector carriage sweep path containment can be of any shape or size as long as the essential characteristic of generally maximum airflow manipulation is maintained. It should be appreciated further that the individual panel elements 110/120/130/140/150, which combine to embody the fluid ejector carriage sweep path containment 100, may be permanent or temporary, fixed or movable, individual elements. Additionally, the individual panel elements 110/120/130/140/150 may be molded individually into the structure of the housing of the fluid ejection device or secured to the internal structure of the fluid ejection device in various exemplary combinations.

In various exemplary embodiments of the systems, methods and structures according to this invention, at least one full-span slotted opening (not shown), as will be described below, usable to provide access for fluid ejection from the fluid ejector elements housed in the fluid ejector carriage 200 to the receiving medium, is included.

In various exemplary embodiments of the systems, methods and structures according to this invention, the motion of the fluid ejector carriage 200, as it translates along at least one structure inside the fluid ejector carriage sweep path containment 100, creates airflow that can be manipulated to beneficial purposes as described in detail below.

In the various exemplary embodiments of the systems, methods and structures according to this invention, openings 300 usable to facilitate desired airflow patterns are added. It should be appreciated that, though depicted in FIG. 1 as located in the end panels 120, these openings can be located anywhere, generally at either end of the carriage sweep path, to facilitate desired airflow through and out of the fluid ejector carriage sweep path containment 100. In various exemplary embodiments of the systems, methods and structures according to this invention, the openings 300 are completely unobstructed holes, or are in the form of vents with louvers, screen and/or other such structures added. As will be detailed below, the openings 300 may include filters usable to trap mist or other contaminants. Also, separate structures, such as, for example, channels, ducting, accordion-style bellows and/or other enclosures usable to direct exhaust air to specific areas inside or outside the fluid ejection device may be added.

Figure 2A:
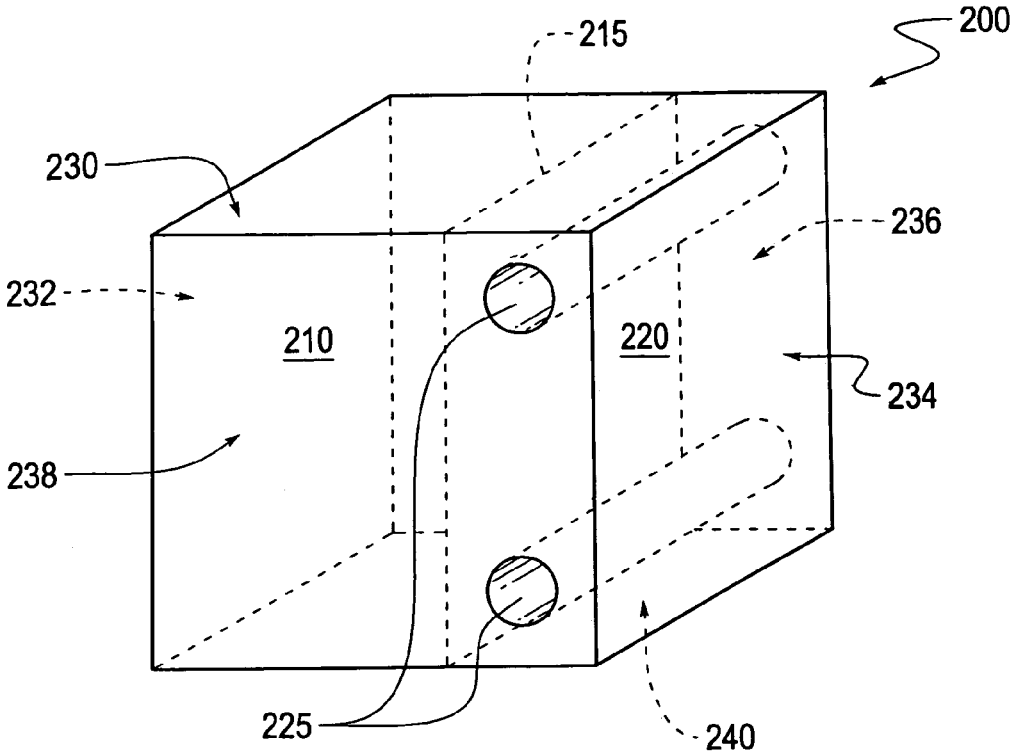
FIGS. 2A–B illustrate a first exemplary embodiment of a fluid ejector carriage usable with various exemplary embodiments of the systems, methods and structures according to this invention.
Figure 2B:
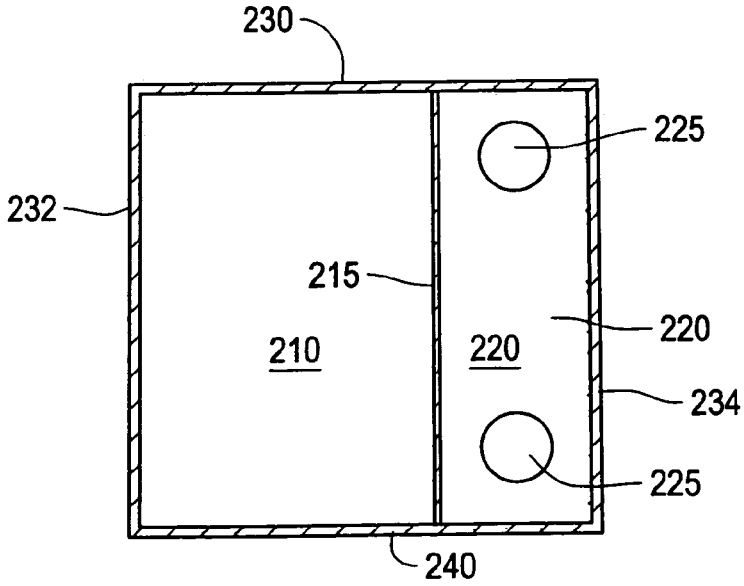

FIGS. 2A–B illustrate a first exemplary embodiment of a fluid ejector carriage 200 usable with various exemplary embodiments of the systems, methods and structures according to this invention. As shown in FIG. 2, the fluid ejector carriage 200 includes a receiving area 210 to house the elements of at least one fluid ejection system. In various exemplary embodiments of the systems, methods and structures according to this invention, fluid ejection elements are mounted to a platform 215. The fluid ejector carriage 200 also includes at least one housing 220 which houses at least one interface structure to provide interface between the fluid ejector carriage and the structure upon which the fluid ejector carriage translates. In cases where these structures are guide rods, the interface structures are then referred to and depicted, in exemplary manner, as fluid ejector carriage rod guides 225. While depicted in FIG. 2 as a single separate housing 220, it should be appreciated that the housing 220 need not be a separate compartment internal to the fluid ejector carriage 200. Rather, any structure to facilitate passage of at least one structure upon which fluid ejector carriage translates (not shown) through the fluid ejector carriage 200, while leaving generally intact the silhouette of the sides of the fluid ejector carriage 200 such that they conform to the overall cross-sectional size and shape of the inside of the fluid ejector carriage sweep path containment, depicted in FIG. 1 as element 100, may be included.

In various exemplary embodiments of the systems, methods and structures according to this invention, the fluid ejector carriage 200 has a top face 230, a front face 232, a rear face 234, side faces 236 and 238, and a bottom face 240. It should be appreciated that the side faces 236 and 238 are necessary to the operation of the invention as described herein. These side faces 236 and 238 conform in silhouette, shape and size to the internal cross-section of the fluid ejector carriage sweep path containment 100. In various exemplary embodiments of the systems, methods and structures according to this invention, faces 230, 232, 234 and 240 may be present or absent as fixed or movable structures as are necessary for the structural integrity of the fluid ejector carriage 200, or for securing the fluid ejection elements therein, while providing access for servicing and/or replacement of these elements in the fluid ejector carriage 200.

Figure 3:
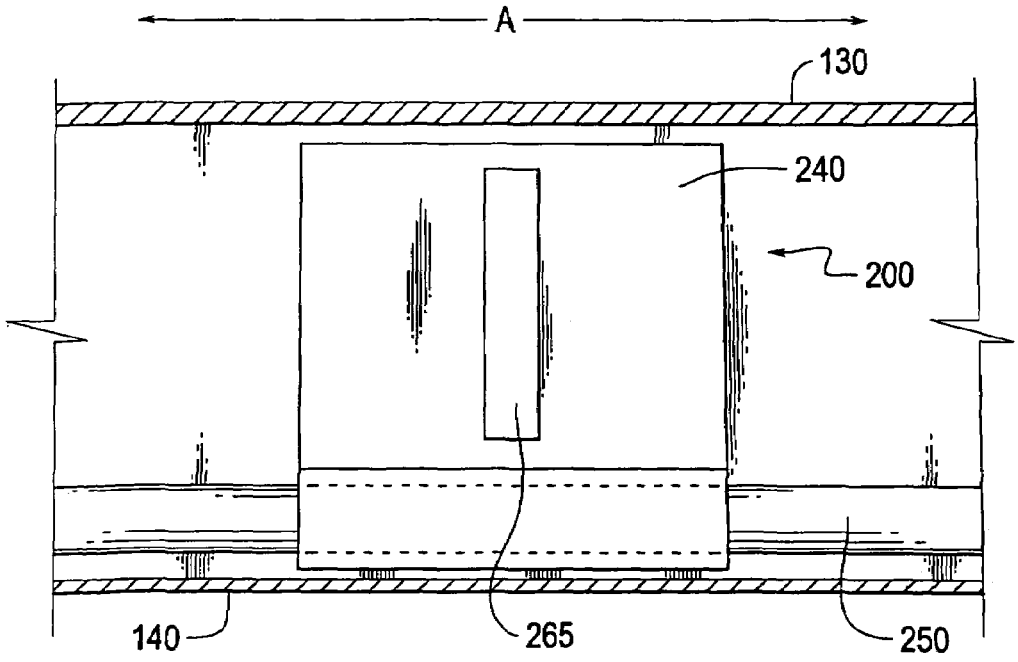
FIG. 3 illustrates a bottom view of a first exemplary embodiment of a fluid ejector carriage usable with various exemplary embodiments of the systems, methods and structures according to this invention.

FIG. 3 illustrates a bottom view of a first exemplary embodiment of a fluid ejector carriage 200 usable with various exemplary embodiments of the systems, methods and structures according to this invention. As shown in FIG. 3, the fluid ejector carriage 200 is mounted on at least one structure upon which the fluid ejector carriage translates, such as, for example, at least one fluid ejector carriage guide rod 250 and between front and back panels 130 and 140 of the fluid ejector carriage sweep path containment 100 (depicted in FIG. 1). At least one fluid ejector element 265 (enlarged for clarity) is mounted on a face of the fluid ejector carriage 200 to deposit fluid on a receiving medium (not shown) as the fluid ejector carriage 200 translates along the at least one fluid ejector carriage guide rod 250 in direction A. It should be appreciated that, though depicted in FIG. 3 as mounted on the bottom face 240 of the fluid ejector carriage, the fluid ejector element 265 could be mounted on, or integral to, any face, front, top, bottom, or back of the fluid ejector carriage 200 that would facilitate access through the corresponding front, top, bottom, or back of the fluid ejector carriage sweep path containment 100 to accomplish fluid ejection from the fluid ejector element 265 onto the receiving medium.

In various exemplary embodiments of the systems, methods and structures according to this invention, the gap between the fluid ejector carriage 200 and the internal faces of the fluid ejector carriage sweep path containment, represented in FIG. 3 by the front panel 130 and the back panel 140, is generally minimized to promote nearly complete airflow manipulation, minimizing leakage around the fluid ejector carriage 200, as the fluid ejector carriage 200 translates along the at least one fluid ejector carriage guide rod 250 in direction A.

Figure 4:
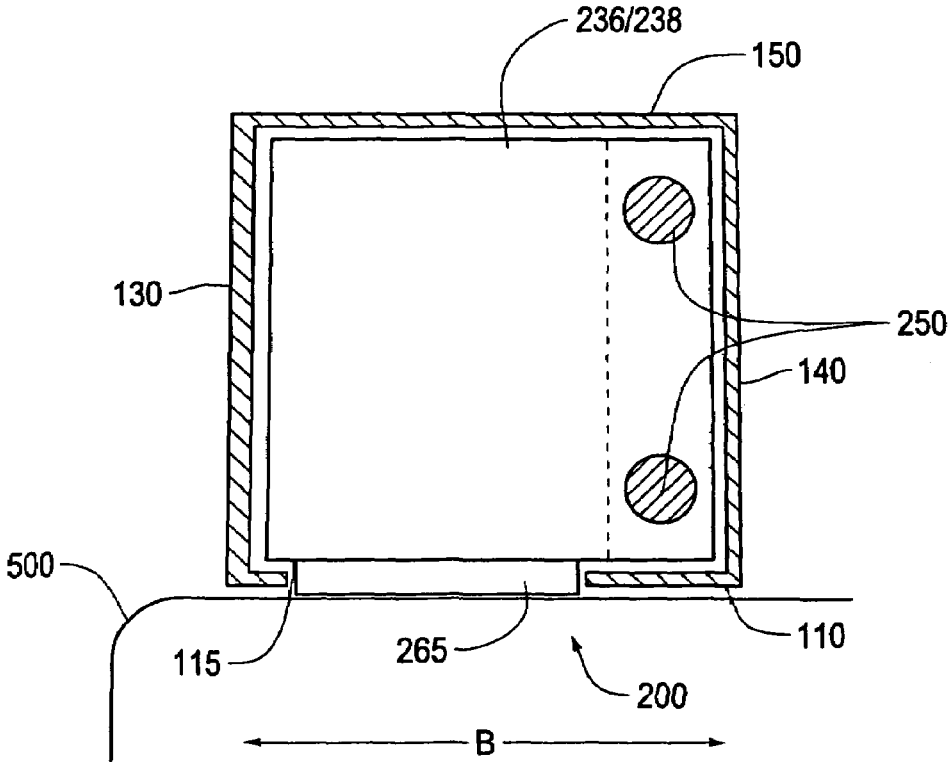
FIG. 4 illustrates a side view of a first exemplary embodiment of a fluid ejector carriage in a fluid ejector carriage sweep path containment usable with various exemplary embodiments of the systems, methods and structures according to this invention.

FIG. 4 illustrates a side view of a first exemplary embodiment of a fluid ejector carriage 200 in a fluid ejector carriage sweep path containment usable with various exemplary embodiments of the systems, methods and structures according to this invention. As shown in FIG. 4, the fluid ejector carriage 200 is surrounded by the panels 110, 130, 140 and 150 of the fluid ejector carriage sweep path containment. The gap between the internal faces of the fluid ejector carriage sweep path containment panels 110/130/140/150 and the fluid ejector carriage 200 is generally minimized on all sides to facilitate as complete airflow movement on either side of, and to minimize leakage past, the fluid ejector carriage 200 as the fluid ejector carriage 200 translates along the at least one structure or fluid ejector carriage guide rod 250 depicted in FIG. 3.

In the various exemplary embodiments of the systems, methods and structures according to this invention, the side faces 236/238 of the fluid ejector carriage 200, conforming in size and shape to the internal cross-sectional area of the fluid ejector carriage sweep path containment, are solid to facilitate the manipulation of the air within the fluid ejector carriage sweep path containment completely external to the fluid ejector carriage 200, as will be described below. It should be appreciated that, although depicted for simplicity and clarity as having a generally rectangular silhouette, the silhouette of the fluid ejector carriage 200 could embody any simple or complex shape, or combination of shapes, and may include at least one protrusion or extension as a structure to facilitate alignment of the fluid ejector carriage in the fluid ejector carriage sweep path containment. For example, see the complex shape illustrated in FIG. 13. In the various exemplary embodiments of the systems, methods and structures according to this invention, the plurality of panels or structures which combine to form the fluid ejector carriage sweep path containment are molded or manufactured such that the internal surfaces of the plurality of panels substantially enclose a volume with a cross-sectional area that conforms in shape and is slightly larger in size than the simple or complex silhouette of the side faces 236/238 of the fluid ejector carriage.

In the various exemplary embodiments of the systems, methods and structures according to this invention, a slot 115 is included to provide access for the fluid ejector element 265 to the receiving medium 500. The slot 115 generally traverses the entire length of a face, for example, the bottom face 110 as depicted in FIG. 4, of the fluid ejector carriage sweep path containment. The receiving medium 500 is separately moved past the fluid ejector carriage sweep path containment in a direction generally perpendicular to the motion of the fluid ejector carriage 200 such that, with each successive sweep of the fluid ejector carriage 200 along the at least one fluid ejector carriage guide rod 250 (depicted in FIG. 3), fluid is ejected in a plurality of generally parallel lines or fields onto the receiving medium 500. It should be appreciated that, though depicted in FIG. 4 as being mounted on the bottom face of the fluid ejector carriage 200, the fluid ejector element 265 necessary for ejecting fluid onto the receiving medium may be mounted on, or integrally into, any face, front, top, bottom or back, of the fluid ejector carriage 200. The slot 115 which provides access for the fluid ejector element 265 to the receiving medium 500 is present in corresponding position on the fluid ejector carriage sweep path containment.

The width of the slot 115 which provides access for the fluid ejector element 265 to the receiving medium 500 does provide the opportunity for leakage of the manipulated airflow based on carriage motion from the fluid ejector carriage sweep path containment. This leakage is, however, minimized as the receiving medium 500 provides a boundary that effectively closes the slot 115 in the bottom face 110. It should be appreciated that, in conventional systems, fluid throw distance from a fluid ejector element to a receiving medium is generally about 2.5 mm or less. The slight gap between the open face 110 of the fluid ejector carriage sweep path containment 100 and the receiving medium 500 results in the receiving medium effectively acting as the airflow boundary to contain the manipulated airflow produced by carriage motion on this side of the fluid ejector sweep path containment 100.

Figure 5A:
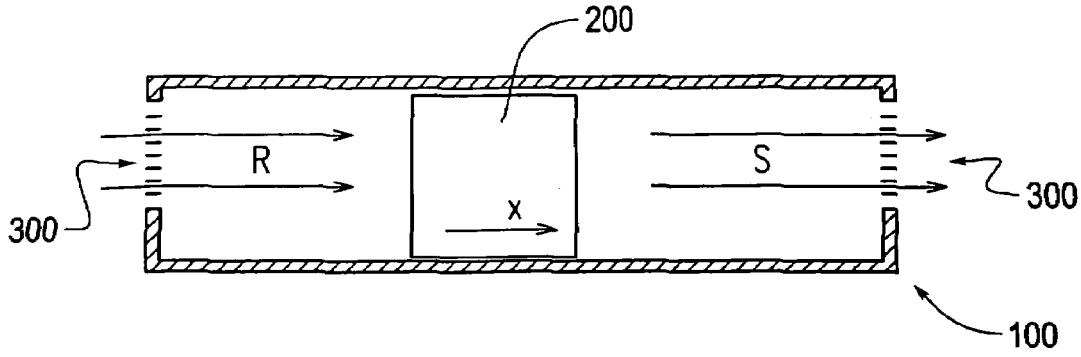
FIGS. 5A–B are schematic diagrams illustrating a first exemplary embodiment of an airflow pattern to support mist removal from a fluid ejector carriage sweep path containment.
Figure 5B:
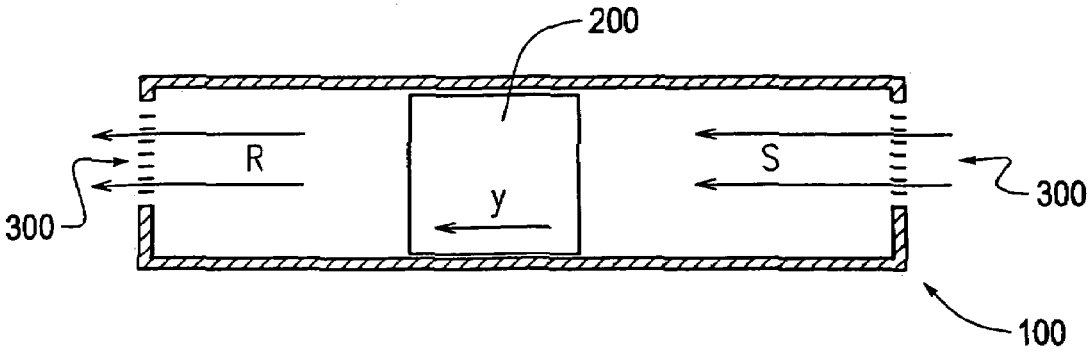

FIGS. 5A–B are schematic diagrams illustrating a first exemplary embodiment of the airflow pattern to support mist removal from the fluid ejector carriage sweep path containment 100. As the fluid ejector carriage 200 translates along at least one structure (not shown) inside the fluid ejector carriage sweep path containment 100 in direction X, air is drawn in through opening 300 into the airflow zone R and is expelled through opening 300 from airflow zone S in the direction shown by the arrows in FIG. 5A. As fluid is ejected by the fluid ejection system onto the receiving medium, residual droplets are formed and trail the fluid ejector carriage 200 in the area of the intake airflow zone R. When fluid ejector carriage motion is reversed, on subsequent sweep in direction Y, the airflow direction in airflow zones R and S reverse, as shown by the arrows in FIG. 5B. As fluid is ejected onto the receiving medium, residual droplets are created and trail the carriage in airflow zone S. The residual fluid mist droplets created on prior sweeps are forcibly expelled by the airflow in airflow zone R through opening 300 before they have a chance to settle on any of the internal structures or surfaces of the fluid ejector sweep path containment.

Figure 6A:
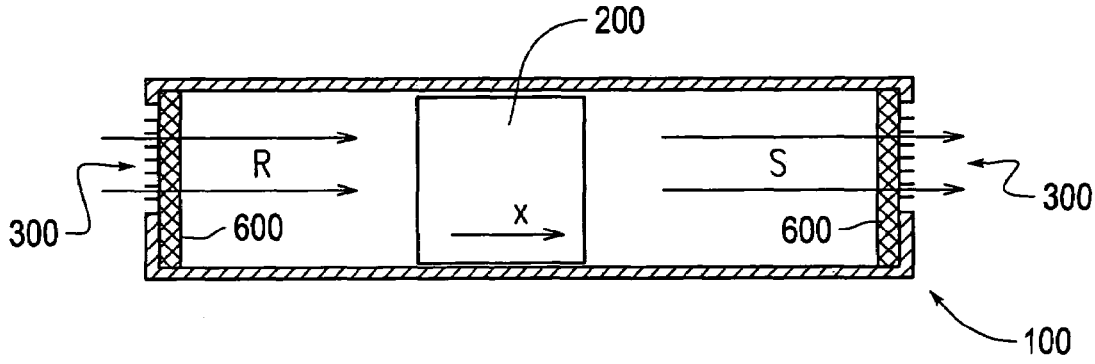
FIGS. 6A–B are schematic diagrams illustrating a second exemplary embodiment of an airflow pattern to support mist removal from a fluid ejector carriage sweep path containment.
Figure 6B:
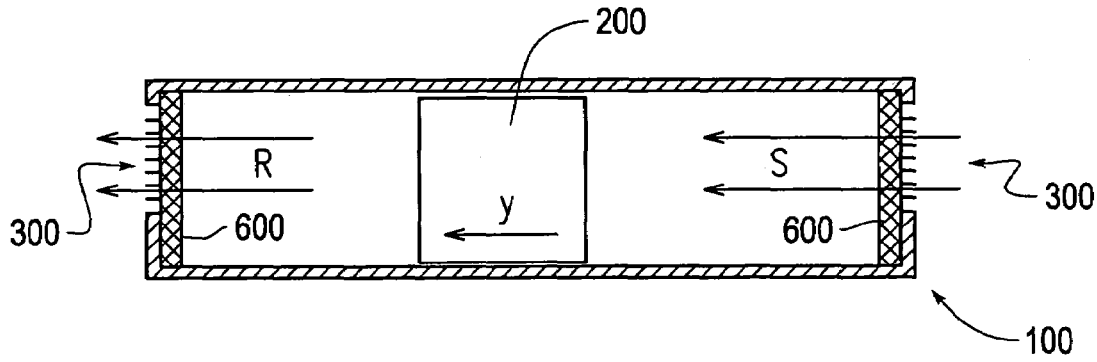

FIGS. 6A–B are schematic diagrams illustrating a second exemplary embodiment of the airflow pattern to support mist removal from the fluid ejector carriage sweep path containment 100. Optional filters 600 are introduced in proximity to the openings 300. As the fluid ejector carriage 200 translates along at least one structure (not shown) inside the fluid ejector carriage sweep path containment 100 in direction X, air is drawn in through opening 300 into the airflow zone R and is expelled through opening 300 from airflow zone S in the direction shown by the arrows in FIG. 6A. When carriage motion is reversed, on subsequent sweep in direction Y, the airflow direction in airflow zones R and S reverses, as shown by the arrows in FIG. 6B. The residual fluid mist droplets created are forcibly expelled in the fluid ejection process by the airflow motion on subsequent sweeps, through filter 600 and opening 300 before the mist droplets settle on any internal structure or surface of the fluid ejector sweep path containment. The addition of fluid mist filters 600, while restricting airflow to some extent, has the advantage that on subsequent sweeps in directions X and Y the fluid mist droplets are generally captured and managed by the filters 600 rather than being freely or completely exhausted out through openings 300.

Figure 7:
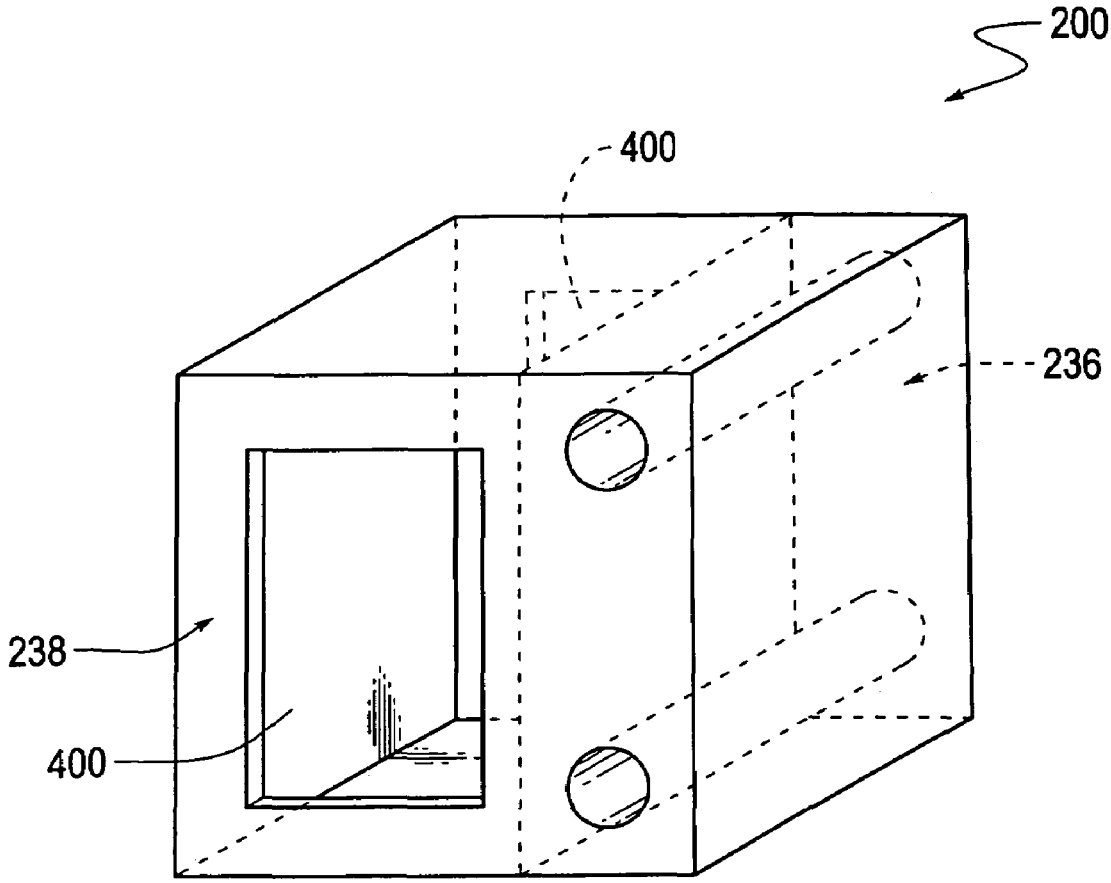
FIG. 7 illustrates a second exemplary embodiment of a fluid ejector carriage usable with various exemplary embodiments of the systems, methods and structures according to this invention.

FIG. 7 illustrates a second exemplary embodiment of a fluid ejector carriage usable with various exemplary embodiments of the systems, methods and structures according to this invention. Openings 400 are added in the side faces 236/238 of the fluid ejector carriage 200, and in any structures that may be added so that the silhouette of the carriage approximates the cross-sectional area of the inside of the fluid ejector carriage sweep path containment. These openings facilitate airflow movement through the fluid ejector carriage 200, as will be described in detail below. In various exemplary embodiments of the systems, methods and structures according to this invention, the openings 400 are completely unobstructed holes in the sides of the carriage, or are in the form of vents with louvers, screen and/or other such structures added. The openings 400 may include filters usable to trap mist or other contaminants. The openings 400 are added to facilitate manipulation of a percentage of the resultant airflow, based on fluid ejector carriage motion, through the fluid ejector carriage 200.

Figure 8:
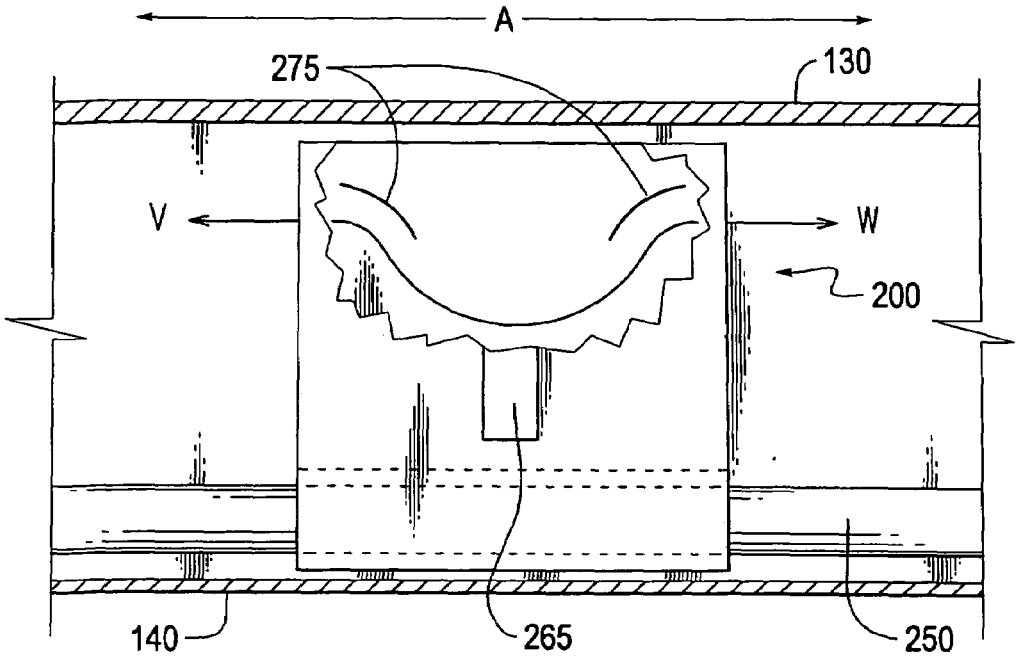
FIG. 8 illustrates a bottom view of a second exemplary embodiment of a fluid ejector carriage usable with various exemplary embodiments of the systems, methods and structures according to this invention.
Figure 9:
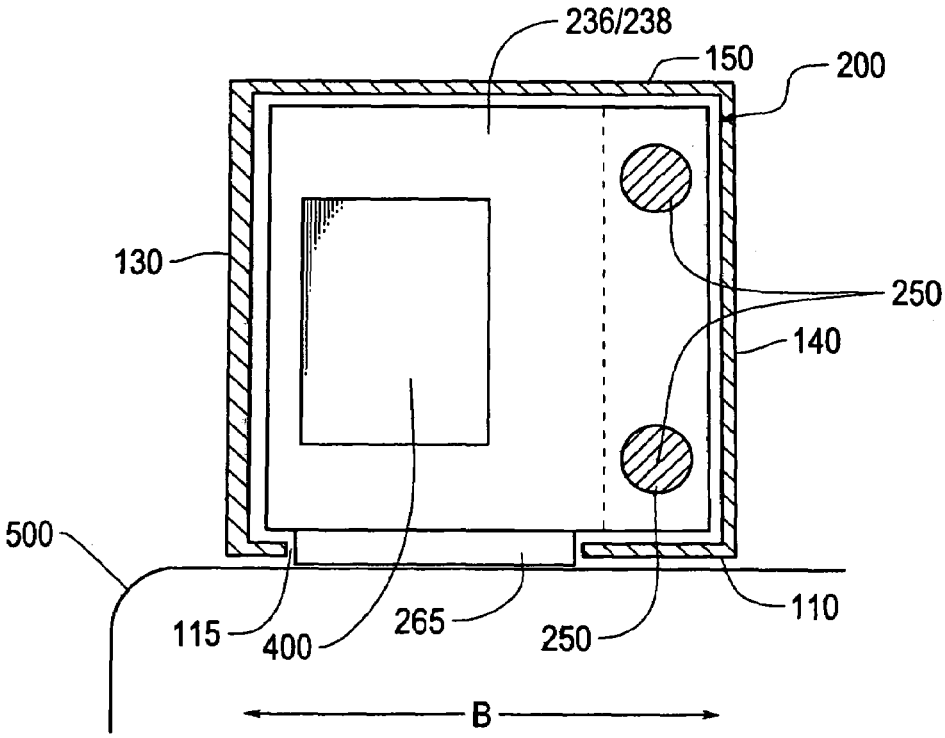
FIG. 9 illustrates a side view of a second exemplary embodiment of a fluid ejector carriage in a fluid ejector carriage sweep path containment usable with various exemplary embodiments of the systems, methods and structures according to this invention.

FIG. 8 illustrates a bottom view of a second exemplary embodiment of a fluid ejector carriage 200 usable with various exemplary embodiments of the systems, methods and structures according to this invention. FIG. 9 illustrates a side view of a second exemplary embodiment of a fluid ejector carriage 200 in a fluid ejector carriage sweep path containment. As shown in FIGS. 8 and 9, the fluid ejector carriage 200 is mounted on at least one structure along which the carriage translates such as, for example, a fluid ejector carriage guide rod 250 and between the front and back panels 130/140 of the fluid ejector carriage sweep path containment 100 (depicted in FIG. 1).

In various exemplary embodiments of the systems, methods and structures according to this invention, at least one structure or device 275 usable to manipulate the resultant airflow that passes through the fluid ejector carriage 200 through the side openings 400 (depicted in FIG. 7) is added. The at least one structure and/or device 275 directs the resultant airflow, generated by fluid ejector carriage motion in direction A, across the heater elements of the fluid ejection module and heat sinks, if installed, to dissipate the heat generated by the fluid ejection operation.

Figure 10A:
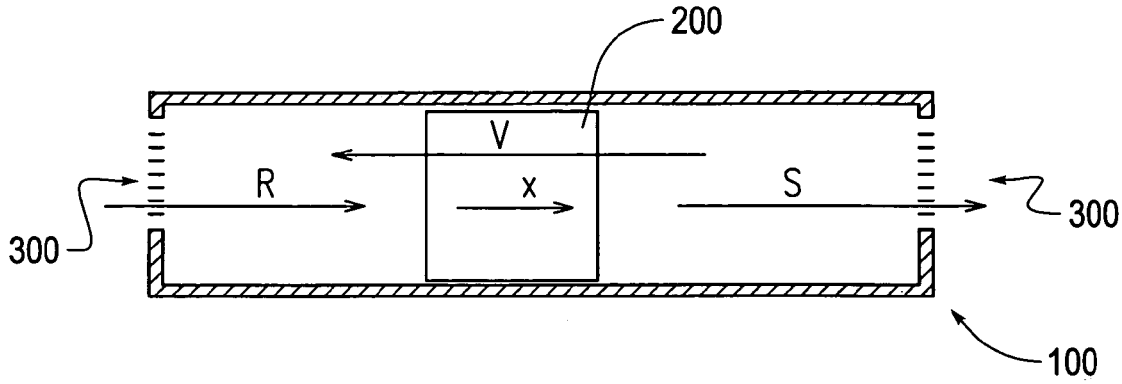
FIGS. 10A–B are schematic diagrams illustrating a first exemplary embodiment of an airflow pattern to support fluid ejection element cooling through the fluid ejector carriage.
Figure 10B:
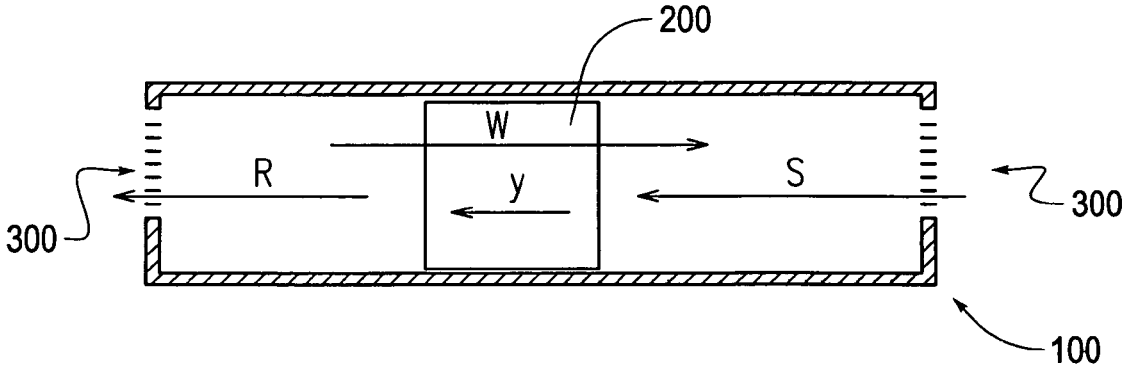

FIGS. 10A–B are schematic diagrams illustrating a first exemplary embodiment of the airflow pattern to support fluid ejector element and/or heat sink cooling through the fluid ejector carriage 200. As the fluid ejector carriage 200 translates along at least one structure (not shown) inside the fluid ejector carriage sweep path containment 100 in direction X air is drawn in through opening 300 into airflow zone R and expelled through opening 300 from airflow zone S in the direction shown by the arrows in FIG. 10A. A percentage of the air inside the fluid ejector carriage sweep path containment 100 passes through the fluid ejector carriage 200 in resultant direction V. This airflow is manipulated by one or more structures and/or devices 275 (depicted in FIG. 8) across the heater elements of the fluid ejector module and heat sinks, if installed, housed in the fluid ejector carriage 200, to dissipate heat. When fluid ejector carriage motion is reversed on a subsequent sweep in direction Y, airflow direction in airflow zones R and S reverse, as shown by the arrows in FIG. 10B. Heated air that remained in airflow zone R based on the resultant airflow V from the previous sweep is then expelled from airflow zone R while resultant airflow W in FIG. 10B is directed through the fluid ejector carriage 200 to continue the cooling process.

Figure 11A:
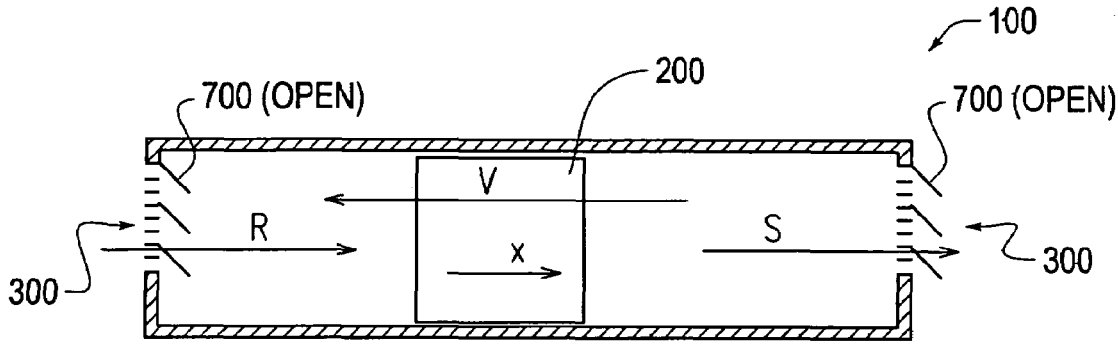
FIGS. 11A–B are schematic diagrams illustrating a second exemplary embodiment of the airflow pattern to support fluid ejection element cooling through the fluid ejector carriage.
Figure 11B:
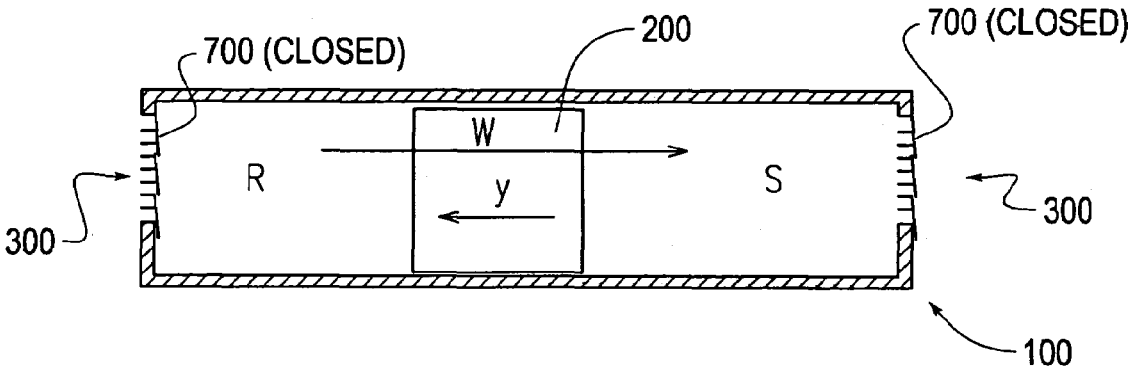

FIGS. 11A–B are schematic diagrams illustrating a second exemplary embodiment of the airflow pattern to support fluid ejector element and/or heat sink cooling through the fluid ejector carriage 200. As shown in FIG. 11A, optional louvers 700 are introduced.

In the various exemplary embodiments of the systems, methods and structures according to this invention, the percentage of the resultant airflow generated by fluid ejector carriage 200 movement in the fluid ejector carriage sweep path containment 100 that is available for fluid ejector element and/or heat sink cooling is dependent on the size of the openings 400 in the side of the fluid ejector carriage 200 and constriction of exhaust air from the fluid ejector carriage sweep path containment 100. Constriction of exhaust air can be accomplished by: decreasing the size of the openings 300 in the ends of the fluid ejector carriage sweep path containment 100; increasing the density of the filter elements 600, depicted in FIG. 6; introducing one-way air vents and/or louvers 700A and B; or, if airflow across the fluid ejector elements and/or heat sink is the only objective, doing away with the openings 300 altogether, resulting in substantially closed ends to the fluid ejector carriage sweep path containment 100.

In the exemplary embodiment of this invention depicted in FIGS. 11A–B, as the fluid ejector carriage 200 translates along at least one structure (not shown) inside the fluid ejector carriage sweep path containment 100 in direction X, air is drawn in through the open louvers 700, in proximity to opening 300, into airflow zone R and exhausted from airflow zone S through louvers 700. A portion of the resultant airflow generated by the fluid ejector carriage motion is forced through the opening in the fluid ejector carriage 200 in the direction depicted by the arrow V in FIG. 11A. When fluid ejector carriage motion is reversed, on a subsequent sweep in direction Y, the airflow patterns in airflow zones R and S stop when the louvers 700 close, as shown in FIG. 11B. Motion of the fluid ejector carriage 200 in direction Y causes air in airflow zone R in front of the fluid ejector carriage, restricted by the closed louvers, from being exhausted, to be reversed such that a larger percentage of the airflow is forced through the openings in the fluid ejector carriage 200 in the resultant direction W, as depicted in FIG. 11B.

Figure 12A:
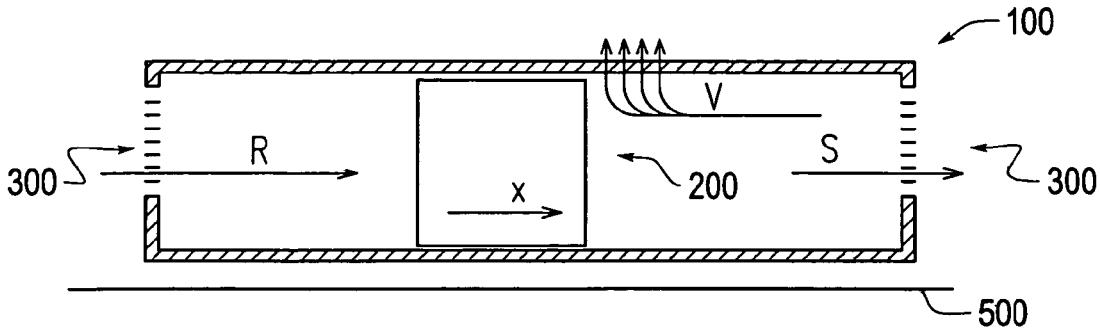
FIGS. 12A–B are schematic diagrams illustrating a first exemplary embodiment of an airflow pattern to support drying the ejected fluid onto receiving medium.
Figure 12B:
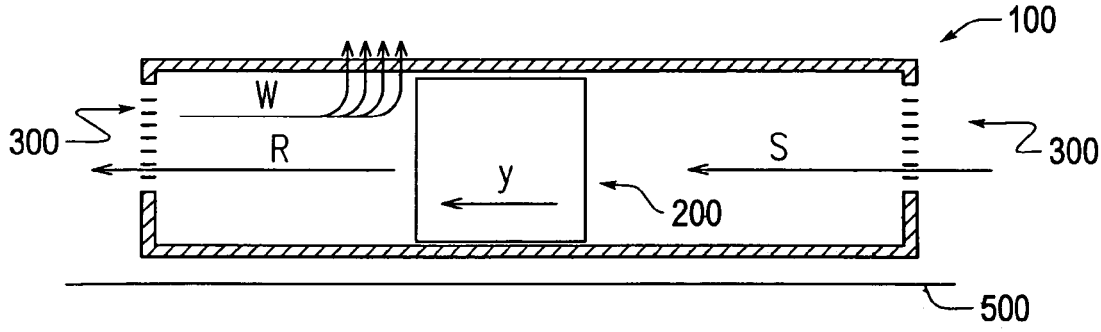

FIGS. 12A–B are schematic diagrams illustrating a first exemplary embodiment of an airflow pattern to support drying and/or setting of the fluid ejected onto a receiving medium. In the various exemplary embodiments of the systems, methods and structures according to this invention, the fully closed carriage depicted in FIGS. 3 and 4 facilitates drying/setting of the fluid deposited on the receiving medium as a portion of the airflow in front of the carriage as it translates along at least one structure will be sheared across the face of the receiving medium based on the piston like effect of the carriage and the fact that the face of the fluid ejector sweep path containment adjacent to the receiving medium is essentially open such that the airflow generated by the carriage motion is not restricted by the structure of the face but rather by the presence of the receiving medium. As the fluid ejector carriage 200 translates along at least one structure (not shown) inside the fluid ejector carriage sweep path containment 100 in direction X, air is drawn in through opening 300 into airflow zone R. Based on constriction in the exit side opening, a portion of the resultant airflow V which meets the face of the fluid ejector carriage 200 is deflected generally in the direction of the receiving medium 500 as shown in FIG. 12A. When fluid ejector carriage 200 motion is reversed, on a subsequent sweep in direction Y, airflow direction in airflow zones R and S reverses, as shown in FIG. 12B, the process of fluid drying/setting continues with each subsequent sweep and the directing of a portion of the resultant airflow toward the receiving medium 500.

In the various exemplary embodiments of the systems, methods and structures according to this invention, enlarging the span-wise slot in the side of the fluid ejector sweep path containment that faces the receiving medium, specifically in the direction that the receiving medium translates, can further facilitate the process of drying/setting fluid deposited on the receiving medium.

Figure 13:
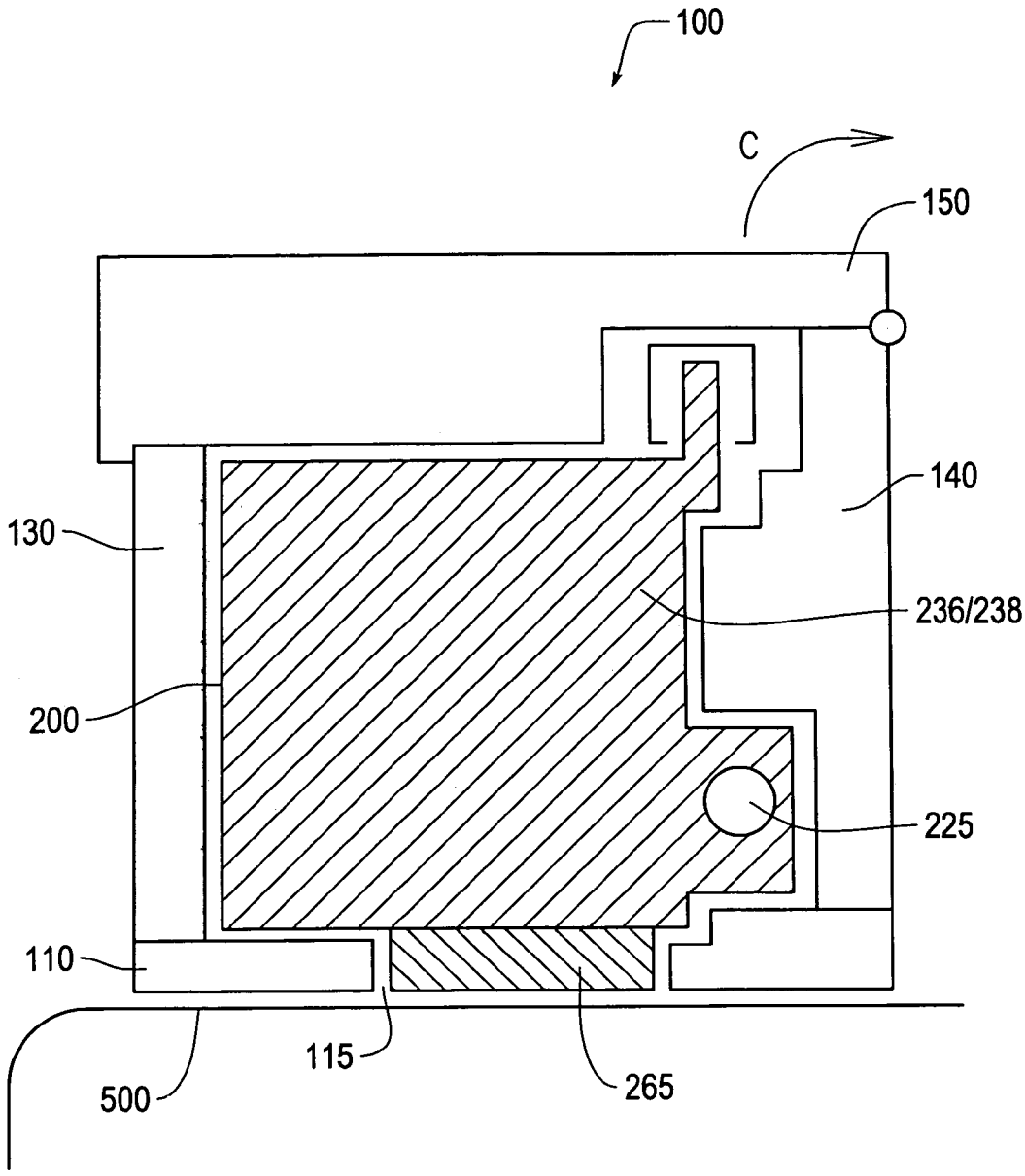
FIG. 13 illustrates a side view of a third exemplary embodiment of a fluid ejector carriage in a fluid ejector carriage sweep path containment usable with various exemplary embodiments of the systems, methods and structures according to this invention.

FIG. 13 illustrates a side view of a third exemplary embodiment of a fluid ejector carriage in a fluid ejector carriage sweep path containment usable with various exemplary embodiments of the systems, methods and structures according to this invention. As shown in FIG. 13, the fluid ejector carriage 200 is surrounded by a bottom panel 110, a front panel 130, a back panel 140, and a movable top panel 150. The movable top panel 150 facilitates access to the fluid ejector carriage 200, for example, when opened in direction C. Movable top panel 150 may be provided with any conventional or subsequently developed removable mounting structure, such as a hinge or a fully removable mount so as to provide access to the sweep path for maintenance, repair or other purpose. It should be appreciated that any of the panels or combinations of panels may be removably provided to facilitate access to the fluid ejector carriage 200 or sweep path.

In the exemplary embodiment depicted in FIG. 13, the fluid ejector carriage 200 includes a structural interface such as a fluid ejector carriage rod guide 225 to accommodate a structure upon which the fluid ejector carriage translates such as, for example, a fluid ejector carriage guide rod (not shown). The side panels 236/238 of the fluid ejector carriage 200 have a complex shape which substantially conforms to the internal cross-sectional shape of the fluid ejector carriage sweep path containment 100 comprising the fluid ejector carriage sweep path containment panels 110/130/140/150. In the exemplary embodiment shown in FIG. 13, the fluid ejector element 265 is mounted on the bottom face of the fluid ejector carriage 200. The fluid ejector carriage sweep path containment 100 provides an opening 115 in the bottom panel 110 to facilitate access of the fluid ejector element 265 to the receiving medium 500.

In the exemplary embodiment depicted in FIG. 13, the gap between the internal faces of the fluid ejector carriage sweep path containment panels 110/130/140/150 and the fluid ejector carriage 200 is generally minimized to facilitate as complete air flow movement on either side of, and to minimize leakage past, the fluid ejector carriage 200 as the fluid ejector carriage 200 translates along the at least one structure. It should be appreciated that the silhouette of the fluid ejector carriage 200 could embody any simple or complex shape or combination of shapes, and may include at least one protrusion or extension as a structure to facilitate alignment of the fluid ejector carriage 200 in the fluid ejector carriage sweep path containment 100.

Figure 14:
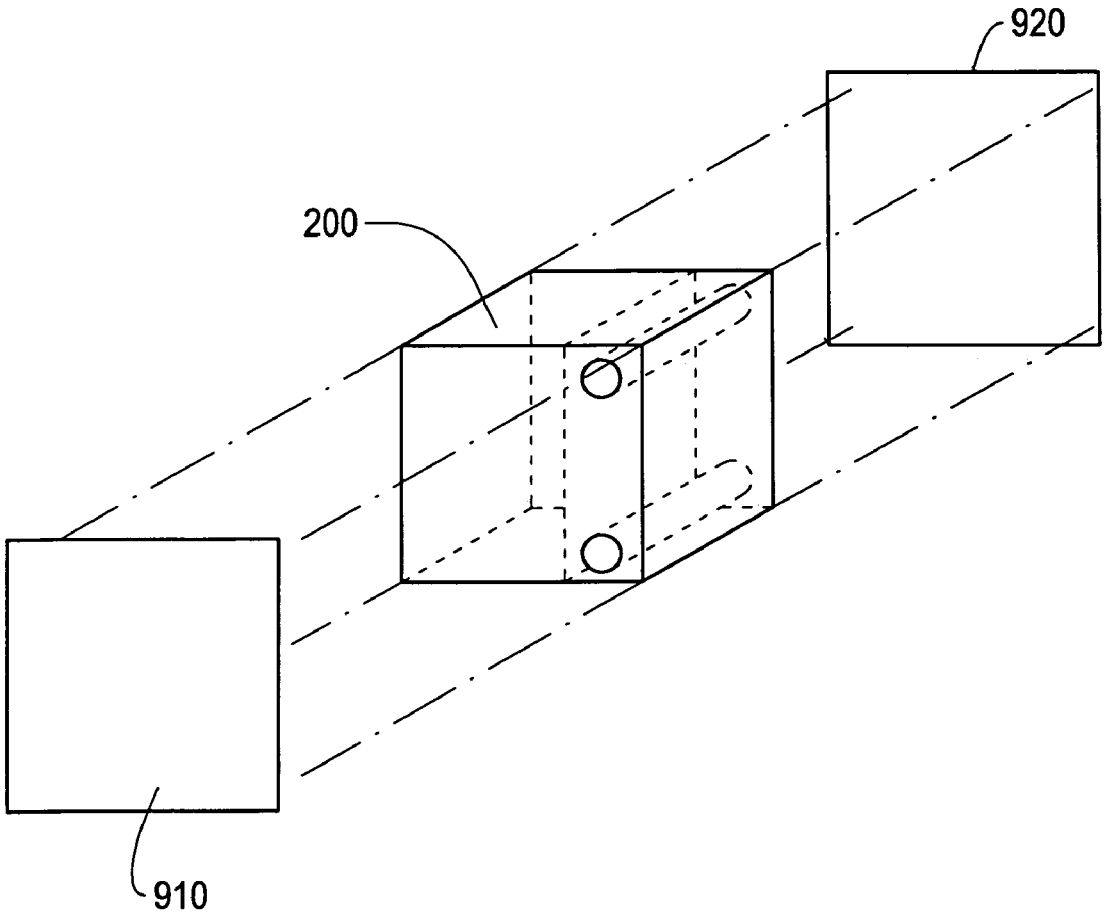
FIG. 14 illustrates a fourth exemplary embodiment of a fluid ejector carriage usable with various exemplary embodiments of the systems, methods and structures according to this invention.

FIG. 14 illustrates a fourth exemplary embodiment of a fluid ejector carriage usable with various exemplary embodiments of the systems, methods and structures according to this invention. As depicted in FIG. 14, structures 910 and 920 are added to the sides of the fluid ejector carriage 200. These structures 910 and 920 are manipulated, shaped and/or enlarged to fit the cross-sectional silhouette of the fluid ejector carriage sweep path containment. Such structures 910 and 920 include, but are not limited to, simple lightweight baffles specifically designed to mirror the cross-sectional shape and size of the inside of the fluid ejector carriage sweep path containment. For simplicity, clarity and ease of depiction, the structures 910 and 920 depicted in FIG. 14 are generally rectangular. It should be appreciated that these structures 910 and 920 can be of any simple or complex shape, and an appropriate size, as long as the essential characteristic of generally promoting maximum airflow manipulation within the fluid ejector sweep path containment is maintained.

In the various exemplary embodiments of the systems, methods and structures according to this invention, at least one non-fluid ejection sweep of the fluid ejector carriage in the fluid ejector carriage sweep path containment may be added to the end of, or interleaved throughout, the fluid ejection process to facilitate: better mist removal and control; additional fluid ejection device cooling; and/or improved drying/setting of all lines or fields of fluid deposited on the receiving medium.

While this invention has been described in conjunction with the exemplary embodiments outlined above, various alternatives, modifications, variations, and/or improvements, whether known or that are, or may be, presently unforeseen, may become apparent. Accordingly, the exemplary embodiments of the invention, as set forth above, are intended to be illustrative, not limiting. Various changes may be made without departing from the spirit and/or scope of the invention. Therefore, the systems, methods, structures and/or devices according to this invention are intended to embrace all known, or later-developed alternatives, modifications, variations, and/or improvements.

What is claimed is:

1. A fluid ejector carriage assembly, comprising:

a fluid ejector carriage containing at least one fluid ejection device;

at least one structure upon which the fluid ejector carriage translates during operation;

one or more panels that substantially enclose a volume in proximity to the fluid ejector carriage and the at least one structure upon which the fluid ejector carriage translates during operation to form a containment around the operating sweep path of the fluid ejector carriage to facilitate manipulation of the airflow produced as the fluid ejector carriage sweeps in a sweep direction along the at least one structure; and an opening in the fluid ejector carriage sweep path containment that provides access to a receiving medium for the fluid ejected from a fluid ejection module as the fluid ejector carriage sweeps along the at least one structure in a sweep direction.

2. The fluid ejector carriage assembly of claim 1, wherein the at least one structure upon which the fluid ejector carriage translates during operation is at least one fluid ejector carriage guide rail or rod.

3. The fluid ejector carriage assembly of claim 1, wherein the one or more panels comprises at least one panel that is a separate, individually molded or manufactured element.

4. The fluid ejector carriage assembly of claim 1, wherein the one or more panels comprises at least one panel that is molded or manufactured as part of an internal surface or structure of the fluid ejector device.

5. The fluid ejector carriage assembly of claim 1, further comprising openings in at least one of the one or more panels, such openings located generally at each end of the fluid ejector carriage sweep path usable to facilitate air intake and/or exhaust on successive sweeps of the fluid ejector carriage.

6. The fluid ejector carriage assembly of claim 5, further comprising at least one filter element located in proximity to at least one of the at least one openings.

7. The fluid ejector carriage assembly of claim 5, further comprising at least one structure or device located in proximity to at least one of the at least one openings usable to allow air intake into the fluid ejector sweep path containment through the opening as the fluid ejector carriage sweeps away from the opening and to restrict air exhaust from the fluid ejector sweep path containment through the opening as the fluid ejector carriage sweeps toward the opening.

8. The fluid ejector carriage assembly of claim 1, wherein the fluid ejector carriage has sides transverse to the sweep direction with silhouettes that approximate the cross-sectional profile, size and shape, of the inside of the fluid ejector carriage sweep path containment.

9. The fluid ejector carriage assembly of claim 8, further comprising at least one opening in a side of the fluid ejector carriage transverse to the sweep direction that allow passage of air through the fluid ejector carriage.

10. The fluid ejector carriage assembly of claim 9, further comprising at least one filter located in proximity to at least one of the at least one side openings.

11. The fluid ejector carriage assembly of claim 9, further comprising airflow path modifying structures and/or devices mounted on, or internal to, the fluid ejector carriage, that modify the path of the air flowing through the fluid ejector carriage through the at least one said side opening.

12. The fluid ejector carriage assembly of claim 1, wherein the opening in the fluid ejector carriage sweep path containment that provides access to the receiving medium for the fluid ejected from the fluid ejection module is expanded generally in the direction of receiving medium motion such that the airflow produced as the fluid ejector carriage sweeps in a sweep direction along the at least one structure is directed generally in the direction of the receiving medium.

13. The fluid ejector carriage assembly of claim 1, further comprising at least one separate structure mounted on at least one side of the fluid ejector carriage transverse to the sweep direction to modify the silhouette of the at least one side of the fluid ejector carriage so that the silhouette, as modified, approximates the cross-sectional profile, size and shape, of the inside of the fluid ejector carriage sweep path containment.

14. The fluid ejector carriage assembly of claim 1, wherein the fluid ejected is ink.

15. A printer device comprising the fluid ejector carriage assembly of claim 1.

16. A method for manipulating the resultant airflow generated by fluid ejector carriage motion in a fluid ejection device, comprising:

operating a fluid ejector carriage, having sides transverse to the sweep direction with silhouettes that approximate the cross-sectional profile, size and shape, of the inside of a fluid ejector carriage sweep path containment that is substantially closed except for the face that is bounded by a receiving medium, to sweep along the carriage motion direction and eject fluid onto a receiving medium; and manipulating the airflow in front of and behind the fluid ejector carriage resulting from the carriage motion to perform a secondary function to fluid ejection.

17. The method of claim 16, wherein the secondary function is substantially venting the air in the fluid ejector carriage sweep path containment on each successive sweep by drawing air in and exhausting air out through openings generally provided at each end of the fluid ejector carriage sweep path.

18. The method of claim 17, further comprising filtering air intake and exhaust on each successive sweep of the fluid ejector carriage.

19. The method of claim 17, further comprising restricting air exhaust on each successive sweep of the fluid ejector carriage with devices in proximity to the openings in the fluid ejector carnage sweep path containment usable to allow air intake as the fluid ejector carriage sweeps away from the opening and to restrict air exhaust as the fluid ejector carriage sweeps toward the opening.

20. The method of claim 17, wherein the secondary function includes manipulating the resultant airflow to remove mist produced by the fluid ejection process in the fluid ejection device.

21. The method of claim 16, further comprising manipulating the airflow to pass through openings in sides of the fluid ejector carnage transverse to the sweep to allow passage of air through the fluid ejector carriage as the fluid ejector carriage sweeps along at least one structure in the sweep direction.

22. The method of claim 21, further comprising filtering the airflow that passes through the openings in the sides of the fluid ejector carriage through filters located in proximity to the openings in the sides of the fluid ejector carriage.

23. The method of claim 21, further comprising directing the airflow that passes through the openings in the sides of the fluid ejector carriage across heater elements and/or heat sinks of the fluid ejection device.

24. The method of claim 21, wherein the secondary function includes manipulating the resultant airflow to dissipate heat from the fluid ejection device produced by the fluid ejection process.

25. The method of claim 16, wherein manipulating the airflow in front of and behind the fluid ejector carriage resulting from the carriage motion further comprises directing and/or deflecting the resultant airflow generated by carriage motion generally in the direction of the receiving medium.

26. The method of claim 25, wherein the secondary function includes manipulating the resultant airflow to dry the fluid ejected onto the receiving medium during the fluid ejection process in the fluid ejection device.

27. The method of claim 25, wherein the secondary function includes manipulating the resultant airflow to set and/or solidify semi-molten fluids deposited onto the receiving medium during the fluid ejection process in the fluid ejection device.

28. The method of claim 16, further comprising operating the fluid ejector carriage through a plurality of non-fluid ejecting sweeps of the fluid ejector carriage interleaved within, or added at the end of, each fluid ejection operation to generally clear the air in the fluid ejector carriage sweep path containment.

* * * * *